US005568827A

United States Patent [19]

Debaes et al.

[11] Patent Number: 5,568,827

[45] Date of Patent: Oct. 29, 1996

[54] WEAVING LOOM WITH SLEY ASSOCIATED DEVICE FOR POSITIONING A WEFT CUTTER

[75] Inventors: Johnny Debaes, Wenduine; Ferdi Dejaegere, Dadizele, both of Belgium

[73] Assignee: N. V. Michel van de Wiele, Kortrijk-Marke, Belgium

[21] Appl. No.: 312,793

[22] Filed: Sep. 27, 1994

[30] Foreign Application Priority Data

Jul. 29, 1993 [BE] Belgium ..... 09300792

[51] Int. Cl.[6] ..... D03D 47/36

[52] U.S. Cl. ..... 139/450; 139/303; 139/170.4; 139/434

[58] Field of Search ..... 139/302, 303, 139/450, 434, 170.4

[56] References Cited

U.S. PATENT DOCUMENTS 3,451,440 6/1969 Golobart ..... 139/303
3,596,685 8/1971 Bassart ..... 139/302
3,903,932 9/1975 Camprubi ..... 139/303

FOREIGN PATENT DOCUMENTS 1571926 6/1969 France .
554434 9/1974 Switzerland .

*Primary Examiner*—Andy Falik
*Attorney, Agent, or Firm*—Sughrue, Mion, Zinn, Macpeak & Seas

[57] ABSTRACT

A weaving loom provided with a device for positioning at least one weft cutter relative to a sley of the weaving loom in a specific direction includes a holder which carries at least one weft cutter and a bearing piece accommodates the holder. The bearing piece can be fixed immovably on the sley, which itself has at least one sley leg and a first end is rotatably connected to the sley by coupling elements. The holder is mounted inside the bearing piece so that it slides in a specific direction.

16 Claims, 3 Drawing Sheets

WEAVING LOOM WITH SLEY ASSOCIATED DEVICE FOR POSITIONING A WEFT CUTTER

FIELD OF THE INVENTION

This invention relates to a weaving loom provided with a device for positioning at least one weft cutter thereon.

BACKGROUND OF THE INVENTION

Known weaving looms are provided with a sley which, as is known, carries out an oscillating movement along a path describing a circular arc. When a weft cutter is fixed directly on the sley of the weaving loom, the weft cutter describes the same path as the sley itself, that is, it also moves in a circular arc. This means that when the sley reaches the open position in its circular arc movement the tips of the weft cutters fixed directly thereon then lie just below the grippers, for presentation of the severed weft to the grippers.

Moreover, during the next beating-up movement, in the beating-up position of the reed the weft cutter moves into a position which is much too high relative to the weft. The disadvantage of this is that the weft cutter is no longer capable of intercepting and severing the weft during such movement.

The above can be overcome by providing additional guide elements such as guide plates, the guide elements lifting up the weft together with the weft cutter. However, the disadvantage of this technique is that it leads to breakdowns, caused by the weft thread becoming stuck. Another disadvantage of this is that it results in the production of longer weft loss ends in the woven fabric, and thus to material loss, and in some cases an increasing risk of manufacturing faults in the woven fabric.

SUMMARY OF THE INVENTION

The object of the invention is to overcome the above-mentioned disadvantages. To this end, the weaving loom is provided with a device for positioning at least one weft cutter relative to the sley of a weaving loom in a specific direction. The device comprises a holder for carrying at least one weft cutter and a bearing piece for accommodating the holder, which bearing piece can be fixed immovably on the sley. In this case the sley has at least one sley leg, a first end of which is rotatably connected to the sley by means of coupling elements. According to the invention, the holder of the device is slidably mounted inside the bearing piece.

According to an advantageous embodiment, the bearing piece comprises a body and a tubular guide element connected immovably thereto, the body forming the part which can be fixed immovably on the sley. The holder comprises a further body and a projecting part which is connected immovably thereto and is provided for sliding inside said guide element, the sliding direction being at right angles to the lengthwise direction of the sley.

A multiple-rod system is also provided according to the invention, for adjusting the slide of the holder in the bearing piece while driving the movement of the sley. In this case the multiple-rod system is coupled at one end to the frame by means of further coupling elements, and is coupled at its other end to the slidable holder. A hinged connection is also provided in this case between with the two ends of the multiple-rod system, said connection pivoting about a coupling shaft which is supported on bearings in said at least one sley leg. Each weft cutter is thus expediently mounted on the holder, and the holder is slidable in the bearing piece. The bearing piece is fixed immovably on the sley in such a way that each weft cutter can carry out a to and fro movement in a specific direction. This to and fro movement is caused by the multiple-rod mechanism, which is driven by means of the sley movement by way of coupling elements. The multiple-rod mechanism in this case forms a balancing lever which is mounted on bearings in the reed lever. In this case one side of the balancing lever is immovably connected to the frame of the weaving loom by means of a drive rod, and the other side of the balancing lever is coupled by means of a further drive rod to the slidable holder.

In the case of weaving looms the loom reed undergoes a movement in which the reed alternately assumes a higher vertical position, on the one hand, and a lower vertical position, on the other hand. When a multiple-rod mechanism is provided, it is desirable in this case for the fall of the woven fabric ultimately to lie as close as possible to the reed, in order to keep the bending moment on the reed dents and on the reed as low as possible. For this purpose, the multiple-rod side of the reed movement is designed in such a way that the reed reaches its highest position in its so-called front, beating-up position and assumes a lower position in its so-called open, rear position. This ensures that warp threads form a downward oriented angle for the shed opening.

According to a particularly advantageous embodiment of the device according to the invention, the multiple-rod system consists of a four-rod mechanism containing a double pair, each pair having a connecting point in said coupling shaft, in which a respective lever engages and forms the connection with a respective drive rod, which drive rods in each case engage in the two ends of the four-rod system.

The slide pair is in this case advantageously inclined in such a way that each weft cutter also has a front and rear component, with the result that both a vertical and a horizontal positioning of at least one weft cutter is possible.

According to a further special embodiment of the device according to the invention, the slide pair is disposed substantially vertically. This means that each weft cutter can carry out a substantially vertical up and down movement, with the result that a height positioning of each weft cutter can be obtained. Some space can be gained through the vertical arrangement.

Further advantages and particulars of the positioning device according to the invention will emerge from the following description of an exemplary embodiment of the device with reference to the appended drawings.

DESCRIPTION OF A PREFERRED EMBODIMENT

Figure 1:
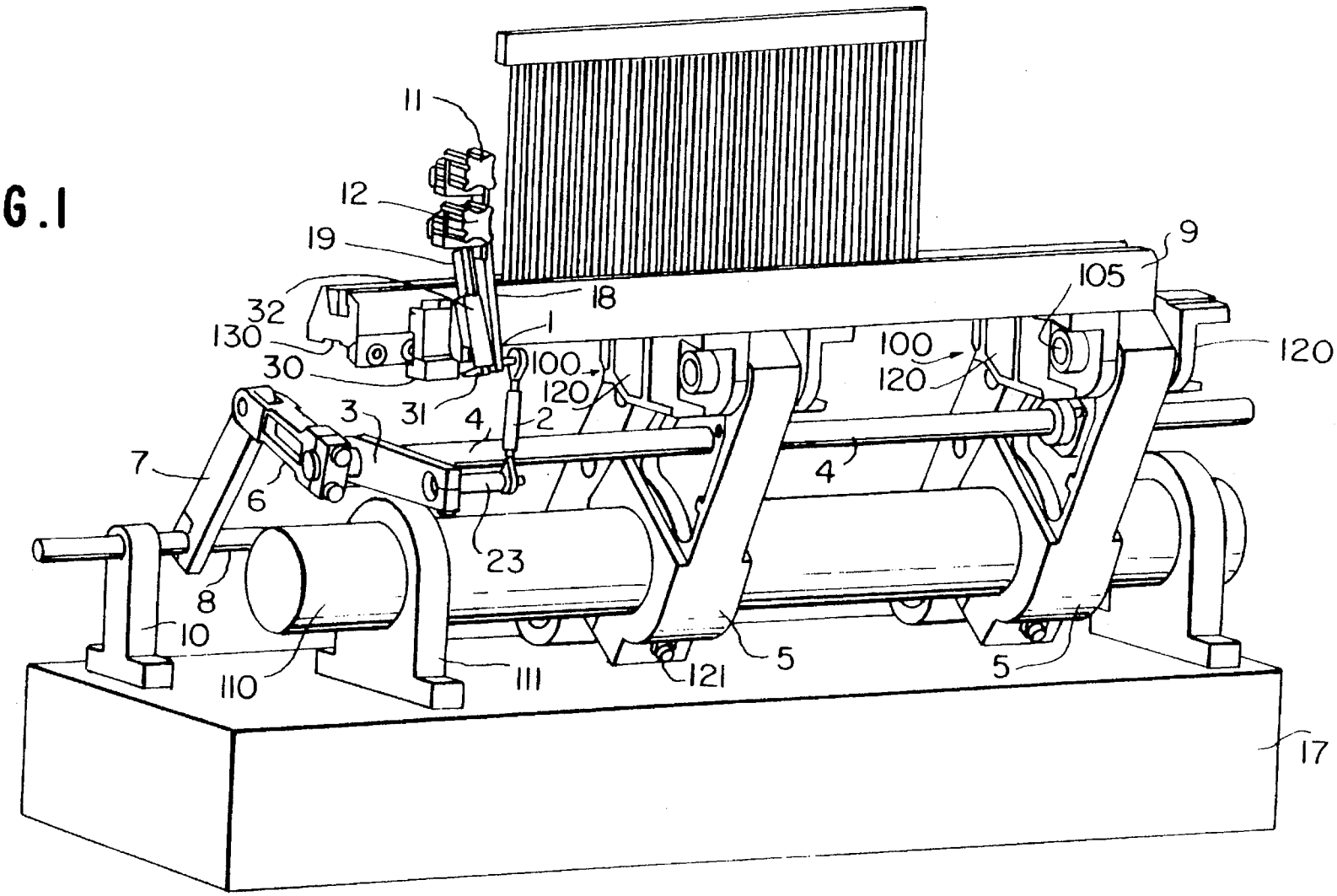
FIG. 1 is a schematic diagram of a positioning device with a loom reed according to the invention.

FIG. 1 shows a general perspective view of the part of a weaving loom in which a positioning device of two weft cutters 11, 12 according to the invention is accommodated.

Figure 2:
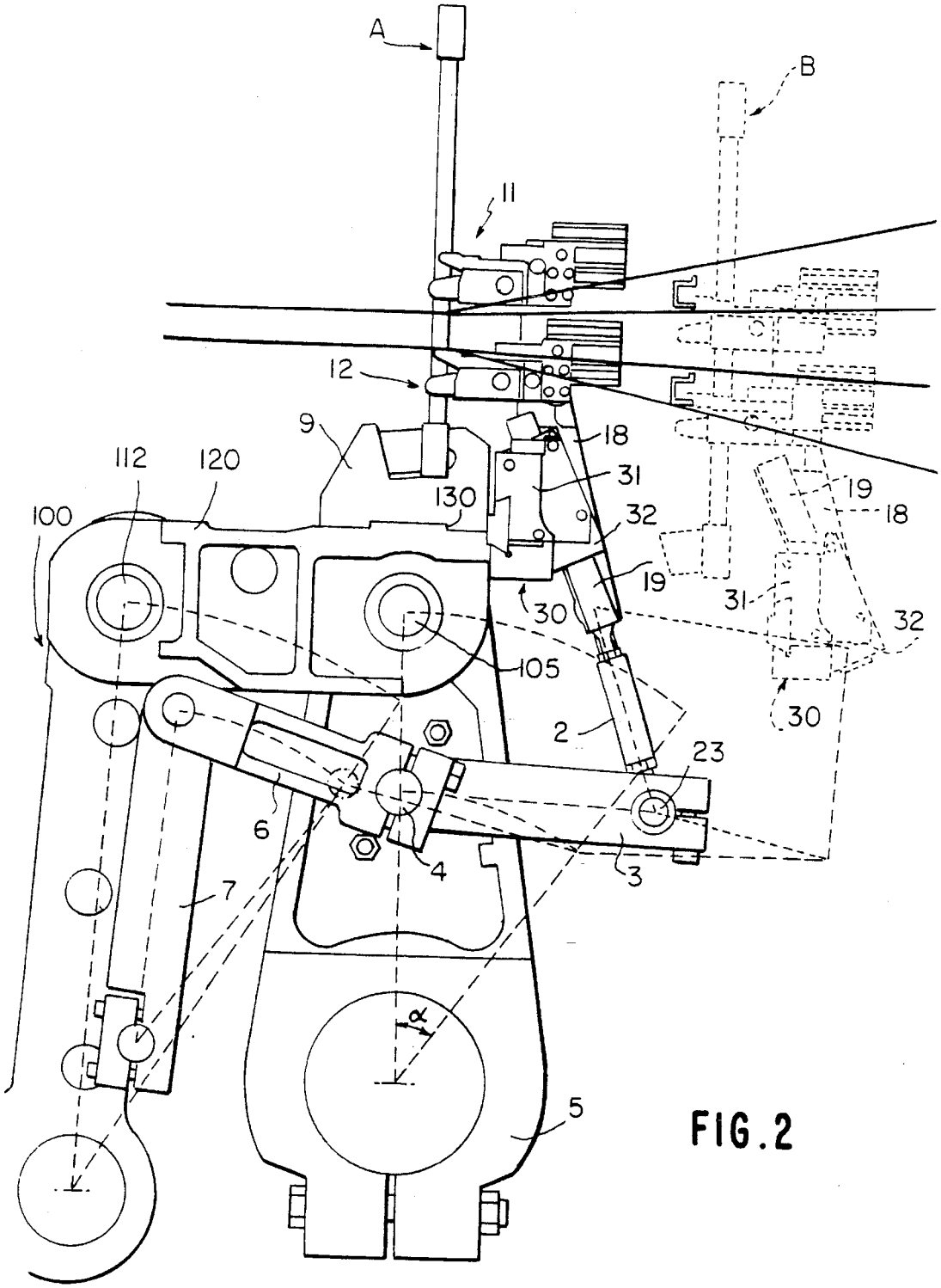
FIG. 2 shows a partial cross-section of the positioning device according to the invention, in the highest position or equilibrium position of the loom reed.
Figure 3:
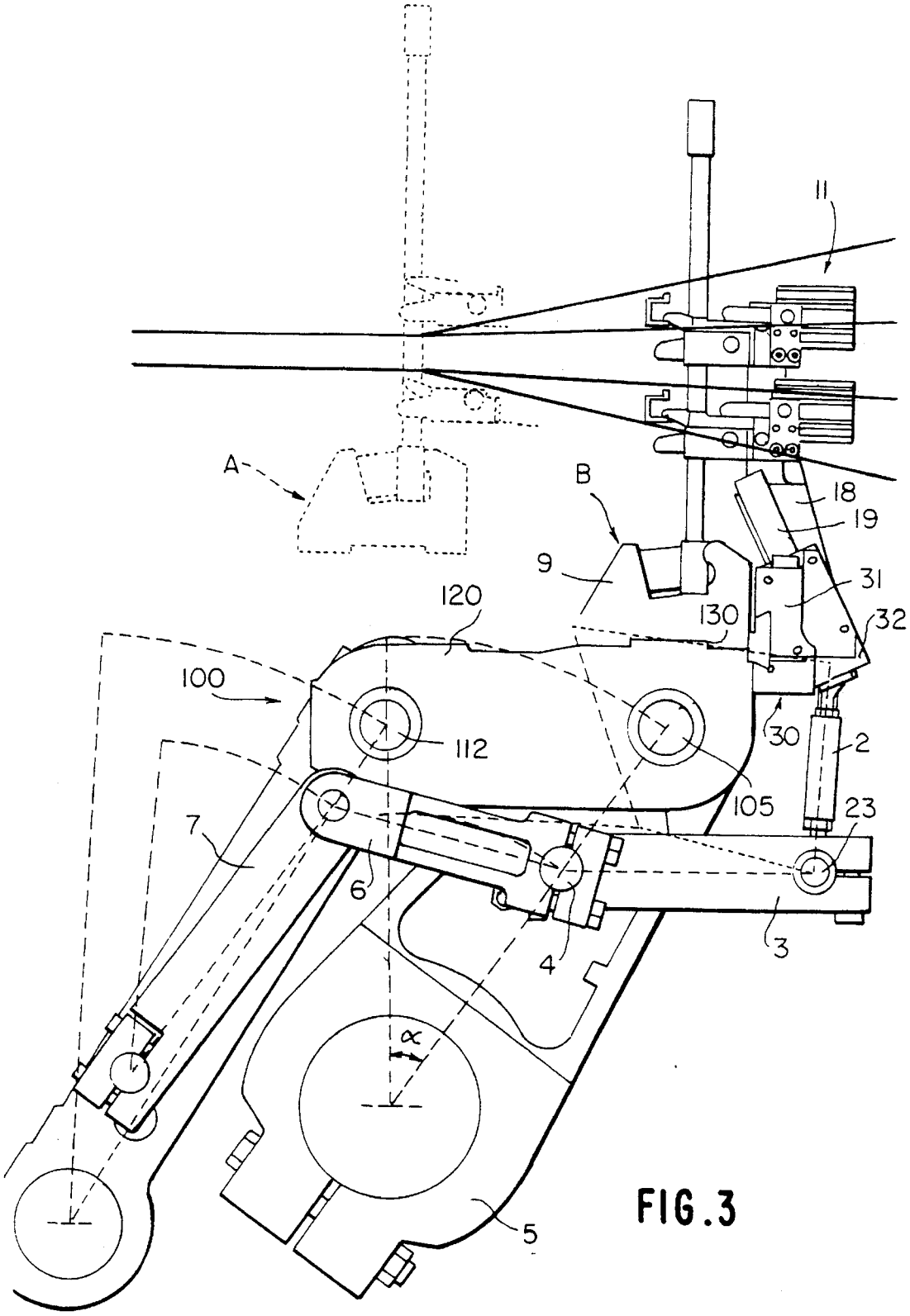
FIG. 3 a diagram similar to that shown in FIG. 2, in a lower or deflected position of the reed.

The weaving loom is provided with a sley 9, which carries out an alternating circular movement through a given angle α (FIG. 3) between a first, highest position A, as shown in FIG. 2, and a second, open position B, as shown in FIG. 3. The sley is moved by being driven by drive elements 100. The sley in this case has a set of elongated sley legs 5, which are disposed at a certain distance from each other and serve as coupling elements between the sley and the sley shaft 110 disposed parallel thereto. The sley shaft is supported in bearing blocks 111 on the frame 17 of the weaving loom and acts as a rotary shaft for the sley by way of the sley legs 5. Each sley leg 5 is in this case rotatably connected at its one end to the sley shaft and at its other end to the sley itself by means of a coupling piece 120 by way of a coupling shaft 105 (see FIG. 2)..

In this case one end of each sley leg 5 is advantageously interrupted in such a way that said one end consists of two arms turned towards each other, in which the tension relative to the sley shaft can be regulated in a suitable manner by means of a tensioning nut 121. The coupling piece 120 is a part of the drive element 100 which is subjected to a movement under the influence of a rotary drive rod, to which it is rotatably connected by means of a shaft 112 supported on bearings therein.

The coupling piece 120 has on its sley side a projecting profile which is suitably provided in a longitudinally profiled recess 130 on the underside of the sley. Each sley leg 5 is driven individually by one corresponding drive element 100, as can be seen from FIG. 1.

Two weft cutters 11, 12 are also immovably mounted together on a holder 1. According to the invention, the holder 1 is slidably disposed in a bearing piece 30, which in turn is fixed laterally to the sley 9. More particularly, the bearing piece 30 consists of an element 31 fixed to the sley 9 and a guide element 32, e.g. tubular, which is immovably connected to the element 31. The holder 1 comprises a bearing plate 18, which serves as a support for the two weft cutters 11, 12, and a projecting part 19 opposite it which is provided for sliding into said tubular guide element of the bearing piece 30, in particular in a direction which is crosswise to the lengthwise direction of the sley 9, which is indicated by arrow F in the figures.

The result is that the two weft cutters 11, 12 can make a to and fro movement relative to the sley in a particular direction. In a substantially vertical arrangement of the slide pair 130, consisting of the slidable holder 1 and the bearing piece 30 to and fro movement of the two weft cutters 11, 12 is substantially vertical, in such a way that a height positioning of the weft cutters is thereby achieved.

However, in a variant, the slide pair 130 can advantageously be given a certain angle of inclination, in such a way that herewith the weft cutters 11, 12 also have a forward and backward movement component.

This embodiment ensures that there can be both vertical and horizontal positioning of the weft cutters 11, 12 relative to the sley.

In order to produce to and fro movement of the weft cutters 11, 12 in a particularly expedient way, a multiple-rod system is provided according to the invention. The drive of the rod mechanism is produced by the movement of the sley itself.

The multiple-rod system according to the invention consists of a balancing lever which is supported on bearings in the reed lever or sley leg 5 by means of a shaft 4. One side of the balancing lever is rotatably coupled to the frame by means of a first drive rod 7, which is immovably connected to a shaft 8 at its one end. The shaft 8 is supported in bearing blocks 16 on the frame 17. At its other end, the first drive rod 7 is connected to a lever 6, which is connected directly to the shaft 4. A further lever 3 is also fixed at one end to shaft 4 and is connected at the opposite end to a second drive rod 2 by way of an intermediate shaft 23. The other side of the balance is thus coupled to the slidable holder 1 by way of said second drive rod 2. This means that the slidable holder 1 can be held in a certain position relative to the sley by said second drive rod 2.

A to and fro rotary movement of the reed lever 5 about the shaft 110 consequently produces the necessary up and down movement of the weft cutters 11, 12. The inclination of the slide pair 130 can also be selected in such a way that the weft cutters 11, 12 slide backwards relative to the loom reed in the beating-up position and slide forwards relative to the reed in the open position, so that the tips of the weft cutter can pass the weft 50 better to the gripper and in front of the reed block.

The abovementioned multiple-rod system can also be driven by means of a cam element 60, which is provided on the frame, and said cam element in this case is rotatably connected to the frame.

We claim:

1. In a weaving loom including a sley and a device for positioning at least one weft cutter relative to a sley of the weaving loom in a specific direction, the improvement comprising;

a holder for carrying said at least one weft cutter, a bearing piece for accommodating the holder said bearing piece fixed immovably on the sley, said sley has at least one sley leg, a first end of which is rotatably connected to the sley by coupling elements, the holder mounted inside the bearing piece for sliding movement within said bearing piece in a specific direction with respect to said sley.

2. A device according to claim 1, wherein the bearing piece comprises a body and a tubular guide element connected immovably thereto, said body forming a portion adaptable to be fixed immovably to the sley, and wherein the holder comprises a further body and a projecting part which is connected immovably thereto and is provided for sliding inside said guide element, the sliding direction being at right angles to the lengthwise direction of the sley.

3. A device according to claim 1, wherein a slide pair is formed by the holder having a projecting part inside said bearing pie, and wherein said bearing piece has a certain inclination.

4. A device according to claim 1, wherein a slide pair is formed by the holder having a projecting part sliding inside said bearing piece, and wherein said bearing piece is disposed substantially vertically.

5. A device according to claim 2, wherein a slide pair is formed by the holder having a projecting part and said guide element, and wherein said bearing piece has a certain inclination.

6. A device for positioning at least one weft cutter relative to a sley of a weaving loom in a specific direction said positioning device, comprising;

a holder for carrying said at least one weft cutter and a bearing piece for accommodating the holder and said holder including a slide, said bearing piece adapted to be fixed immovably on the sley, at least one sley leg, a first end for being rotatably connected to the sley by means of coupling elements, wherein the holder is mounted inside the bearing piece to slide in a specific direction, a multiple-rod system for adjusting the slide of the holder in the bearing piece while driving the movement of the sley, the multiple-rod system being adapted to be coupled at its one end to the loom frame by means of coupling elements and being coupled at its other end to the slidable holder, and a hinged connection between said two ends of the multiple-rod system, said connection pivoting about a coupling shaft which is supported on bearings in said at least one sley leg.

7. A device according to claim 6, wherein said multiple-rod system consists of a four-rod mechanism containing a double pair, each pair respectively having a connecting point in said coupling shaft, in which a respective lever engages and forms the connection with a respective drive rod, which drive rods in each case engage in said two ends of the multiple-rod system.

8. A device according to claim 6, wherein the bearing piece comprises a body and a tubular guide element connected immovably thereto, said body forming the part which can be fixed immovably to the sley, and wherein the holder comprises a further body and a projecting part which is connected immovably thereto and is provided for sliding inside said guide element, the sliding direction being at right angles to the lengthwise direction of the sley.

9. A device according to claim 6, wherein a slide pair is formed by the holder having a projecting part inside said bearing piece, and wherein said bearing piece has a certain inclination.

10. A device according to claim 6, wherein said multiple-rod system is adapted to be driven by a cam element rotatably connected to the loom frame.

11. A device according to claim 7, wherein a slide pair is formed by the holder having a projecting part and said guide element, and wherein said bearing piece has a certain inclination.

12. A device according to claim 7, wherein, said multiple rod system is adapted to be driven by a cam element rotatably connected to the loom frame.

13. A wearing loom comprising positioning device for positioning at least one weft cutter relative to a sley in a specific direction, said positioning device comprising;

a holder for carrying said at least one weft cutter and a bearing piece for accommodating the holder, said bearing piece adapted to be fixed immovably on the sley, at least one sley leg, a first end of said sley leg rotatably connected to the sley by means of coupling elements, wherein the holder is mounted inside the bearing piece so that it slides in a specific direction.

14. Positioning device according to claim 13, wherein the bearing piece comprises a body and a tubular guide element connected immovably thereto, said body forming the part which can be fixed immovably to the sley, and wherein the holder comprises a further body and a projecting part which is connected immovably thereto and is provided for sliding inside said guide element, the sliding direction being at right angles to the lengthwise direction of the sley.

15. Positioning device according to claim 13, wherein a multiple-rod system is provided for adjusting the slide of the holder in the bearing piece while driving the movement of the sley, the multiple-rod system being coupled at its one end to the loom frame by means of coupling elements, and being coupled at its other end to the slidable holder, and a hinged connection also being provided between said two ends of the multiple-rod system, said connection pivoting about a coupling shaft which is supported on bearings in said at least one sley leg.

16. Positioning device according to claim 15, wherein said multiple-rod system consists of a four-rod mechanism containing a double pair, each pair respectively having a connecting point in said coupling shaft, in which a respective lever engages and forms the connection with a respective drive rod, which drive rods in each case engage in said two ends of the multiple-rod system.

* * * * *